US011810537B1

(12) United States Patent
Maniatty

(10) Patent No.: US 11,810,537 B1
(45) Date of Patent: Nov. 7, 2023

(54) DRUM DAMPENER KIT

(71) Applicant: Philip Maniatty, Killington, VT (US)

(72) Inventor: Philip Maniatty, Killington, VT (US)

( * ) Notice: Subject to any disclaimer, the term of this patent is extended or adjusted under 35 U.S.C. 154(b) by 0 days.

(21) Appl. No.: 17/822,042

(22) Filed: Aug. 24, 2022

(51) Int. Cl.
*G10D 13/14* (2020.01)

(52) U.S. Cl.
CPC ..... *G10D 13/14* (2020.02)

(58) Field of Classification Search
CPC .. G10D 3/12; G10D 1/08; G10D 3/04; G10D 3/153
See application file for complete search history.

(56) References Cited

U.S. PATENT DOCUMENTS

| | | | | |
|---|---|---|---|---|
| 4,244,266 | A | 1/1981 | Hardy | |
| 4,325,281 | A | 4/1982 | Hardy | |
| 4,567,807 | A | 2/1986 | Robinson | |
| 4,899,635 | A | 2/1990 | Santangelo | |
| 5,561,254 | A * | 10/1996 | Huffer | G10D 13/14 84/452 P |
| 5,892,168 | A | 4/1999 | Donohoe | |
| 5,920,021 | A | 7/1999 | Good | |
| 6,291,754 | B1 | 9/2001 | Gatzen et al. | |
| 6,696,630 | B2 | 2/2004 | Gatzen | |
| 7,214,867 | B1 | 5/2007 | Gatzen et al. | |
| 7,476,794 | B2 | 1/2009 | May, Jr. | |
| 8,148,619 | B1 | 4/2012 | May et al. | |
| 8,541,675 | B2 | 9/2013 | Strickland | |
| 8,895,827 | B1 | 11/2014 | Grossman | |
| 9,159,305 | B1 | 10/2015 | Mazzarisi | |
| 9,190,037 | B2 | 11/2015 | May | |
| 9,711,116 | B2 | 7/2017 | Strickland | |
| 10,163,426 | B2 | 12/2018 | Yoshino | |
| 2012/0325072 | A1 | 12/2012 | Eckermann | |

OTHER PUBLICATIONS

Big Fat Snare Drum, Original, https://bigfatsnaredrum.com/products/studio-pack-original.
Big Fat Snare Drum, Steve's Donut, https://bigfatsnaredrum.com/products/bfsd-steves-donut.
K.J. Music, DrumClip, http://thedrumclip.com/about-us.html.
Drumhead Authority, O-Rings, https://drumheadauthority.com/product/o-rings/.
Sweetwater Sound, Evans E-Rings, https://www.sweetwater.com/store/detail/ERStandard--evans-e-rings-standard-back.

(Continued)

*Primary Examiner* — Kimberly R Lockett

(57) ABSTRACT

A drum dampener kit with a dampener and stabilizers. The dampener includes an annular ring made from a relatively dense material such as steel, and a pad. The ring is the same as or slightly smaller than the drumhead. The width and thickness depend on the desired weight. The pad is a soft material attached by an adhesive either to the ring on the bottom or wrapped around the outside edge. The pad is a single piece around the entire circumference or a plurality of pad sections spaced around the ring. The stabilizer has a hook that hooks under the drum hoop and loops over the top of the hoop to a foot that holds the dampener onto the drumhead. Studs on the top of the ring and a complementary holes in each stabilizer provide a mechanism for retaining the dampener in the correct position on the drumhead.

20 Claims, 13 Drawing Sheets

(56) References Cited

OTHER PUBLICATIONS

Music & Arts, Evans Min-EMAD Tom and Snare Dampener Standard, https://www.musicarts.com/evans-min-emad-tom-and-snare-dampener-main0018016#!#full-description.
Remo Inc., Muff'l Control Ring, https://remo.com/products/product/muffl-control-ring/.
Remo Inc., Remo Rings, https://remo.com/products/product/remo-rings/.
Snareweight LLC, Snareweight, https://www.snareweight.com/.
Tama Drums, Soft Sound Ring, https://www.tama.com/usa/products/detail/sound_reducer.html.

* cited by examiner

DRUM DAMPENER KIT

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to drums, more particularly, to devices that dampen the resonance and enhance the tone of a drum.

2. Description of the Related Art

The majority of drum attenuators are designed to reduce a very small amount of vibration generated from the batter head when struck with a drumstick or drum mallet. Although there are a variety of designs and materials utilized, they all stay within a small range of attenuation due to their light weight.

Additionally, the types of materials used and their corresponding design intend to attenuate just the "rattle" or unwanted vibration. None of these products address the ability to fundamentally enhance the tone of the drum. Often a deeper richer thicker tone is desired, which is impossible to achieve with current products and difficult to achieve using a combination of these products.

Further, drawbacks exist in the stability of these products. Most drums are set to play at an angle so that the batter head is not horizontal, and many of the current attenuation products tend to move, shift, slide, or bounce off the drumhead when they are being played hard. In the case of a kick drum, most current products cannot be used at all because the drum sits on its side.

A much wider variety of tone options can be achieved if the resonant head can be attenuated the same way the batter head is. Unfortunately, most existing products cannot be mounted to the resonant head.

The current products reduce vibration, which does change the tone to a small degree, but products that fundamentally deepen and enhance the tone of the drum are currently unavailable. In many instances, a larger amount of attenuation is desired, and with current products, the amount of attenuation available is relatively minimal.

BRIEF SUMMARY OF THE INVENTION

The present invention is a drum dampener kit that includes a dampener and stabilizers. The dampener includes a ring and a pad. The ring can have any number of configurations that are variations on an annulus and partial annulus, where an annulus is a circle with a concentric circular opening. The ring is made from a relatively dense material, such as a metal, preferably a steel.

The ring has three dimensional parameters of note, the diameter, the thickness, and the width, which is the difference between the radius of the ring and the radius of the opening. In one configuration, the ring diameter is about the same as the drumhead diameter. In another configuration, the ring diameter is smaller than the drumhead diameter in order to accommodate the pad.

The width and thickness depend on the desired weight of the ring based on the material from which it is made. The width is in the range of from ½ inch to 1½ inch with a preferred width of about 1 inch, and the thickness is in the range of from 1/16 inch to 3/16 inch, with a preferred thickness of about ⅛ inch.

There are several different approaches to setting the weight of the ring. In one approach, the width and thickness are selected to achieve a desired weight. In another approach, the width and thickness are the same for all diameters of the ring.

The dampener has a pad attached to the ring. The pad is a soft material that is attached to the ring by a strong adhesive. There are at least two configurations of the pad. In one, the pad is attached only to the bottom of the ring. In another, the pad wraps around the ring from the bottom, around the outer edge, to the top. In one form, the pad is a single piece that extends around the entire circumference of the ring. In another form, the pad is a plurality of small pad sections that are spaced around the ring.

The stabilizer is a clip that holds the dampener in place on the drumhead. The stabilizer has a hook that curves around and spans the outside of the drum hoop with the finger that hooks under the bottom of the hoop. An elbow at the other end of the hook loops over the top of the hoop and connects to a foot. The foot is generally wedge-shaped or generally L-shaped with a bottom that pushes down on the dampener sitting on the drumhead. The foot extends away from the hoop far enough to hold the dampener against the drumhead.

The stabilizer is composed of a material that holds its undeformed shape but that can flex enough that the stabilizer can be installed on the drum as described below. The stabilizer returns to its undeformed shape when removed from the drum.

Optionally, the dampener and stabilizer include a mechanism for retaining the dampener in the correct position on the drumhead. The mechanism comprises a plurality of studs extending from the top of the ring and a complementary hole in the foot of each stabilizer. Alternatively, the mechanism comprises a plurality of holes in the ring and stud extending from the bottom of the foot. When the stabilizer is installed on the dampener, the stud fits in the hole.

The drum dampener kit is installed by first laying the dampener against the drumhead. For each of the stabilizers, the stabilizer finger is hooked under the hoop, and the foot hooked over the top of the hoop and is allowed to drop to the dampener, making sure that the stud and hole are aligned. Alternatively, the elbow is placed over the top of the hoop such that the stabilizer foot is on the dampener, making sure that the stud and hole are aligned. Then the finger is hooked under the hoop.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
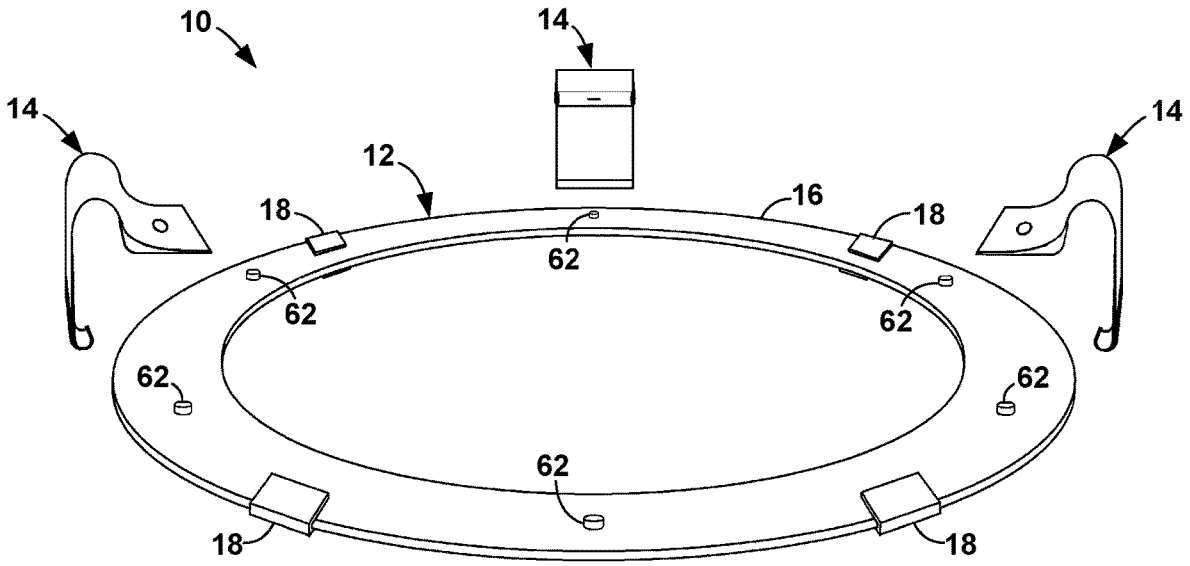
FIG. 1 is a perspective view of the drum dampener kit of the present invention.

The present invention is a drum dampener kit 10 that includes a dampener 12 and stabilizers 14, as shown in FIG. 1. The drum dampener kit 10 is intended for use with a drum 2 that has a batter head 4*a* on one side of a cylindrical shell 3 and, optionally, a resonant head 4*b* on the opposite side of the shell 3. Since the present invention can be used on either or both of the batter head 4*a* and resonant head 4*b*, the term "drumhead" 4 is use in the present specification and claims to mean either one. A hoop 5 secures the drumhead 4 to the shell 3.

The dampener 12 is comprised of a ring 16 and a pad 18.

Figure 2:
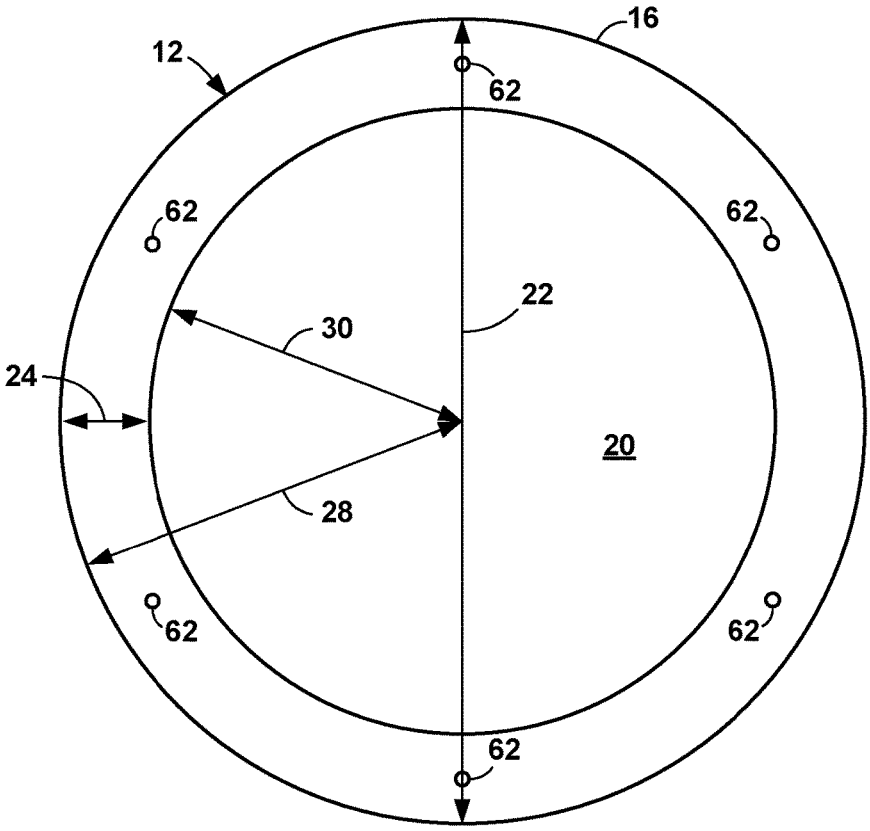
FIG. 2 is a top view of one configuration of the dampener.

In a first configuration, shown in FIG. 2, the ring 16 is in the shape of an annulus. In other words, the ring 16 is a circle with a concentric circular opening 20. In a second configuration, shown in FIG. 3, the ring 16 is in the shape of a half-annulus. In other words, the ring 16 is a partial annulus of 180°. In other configurations, not shown, the ring 16 is shaped as other size partial annuluses, such as 90°, 120°, or 270° of a full annulus. In the remainder of the present specification and in the claims, unless otherwise indicated, the term "annulus" is intended to encompass a full annulus and any size partial annulus.

The rings 16 that are not full annuluses provide the user with more flexibility. They can be used in different combinations on one drumhead 4 to achieve different tonal qualities. Further, a pair of rings 16, each of about 135°, can be used on the resonant head of a snare drum where the two rings straddle the snare wire.

The ring 16 is made from a relatively dense material, such as a metal, with a density in the range of from 4.25 oz/in$^3$ to 4.75 oz/in$^3$. The preferred material is a steel because it provides the desirable combination of high density and low cost. The density of steel runs from 4.480 oz/in$^3$ to 4.656 oz/in$^3$ depending on the particular type of steel, with typical raw steel having a density of 4.544 oz/in$^3$. Optionally, for a cleaner look and feel, the ring 16 is powder coated.

Figure 4:
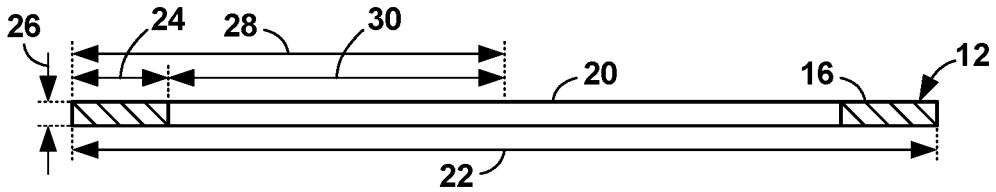
FIG. 4 is a side, cross-sectional view of the full-annulus ring.

The ring 16 has three dimensional parameters of note, the diameter 22, the width 24, and the thickness 26, shown in FIG. 4. The width 24 is the difference between the radius 28 of the ring 16 and the radius 30 of the opening 20.

In one configuration, the diameter 22 of the ring 16 is about the same as the diameter of the drumhead 4 for which the dampener 12 is intended so that the dampener 12 extends around the perimeter of the drumhead 4 out to the hoop 5. For example, if the drumhead 4 is 14 inches in diameter, the ring 16 of a dampener 12 intended for that drumhead 4 is also 14 inches in diameter.

In another configuration, the ring diameter 22 is smaller than the drumhead diameter in order to accommodate configurations of the pad 18, as described below.

The width 24 and thickness 26 will depend on the desired weight of the ring 16 based on the material from which the ring 16 is made. In general, the width 24 will be in the range of from ½ inch to 1½ inch with a preferred width of about 1 inch. In general, the thickness 26 will be in the range of from 1/16 inch to 3/16 inch, with a preferred thickness of about ⅛ inch.

The term, "about", is used to denote that dimensions are achievable only within a tolerance. Further, exact dimensions are not necessary for the present invention and a relatively wide tolerance, on the order of ±10%, is acceptable. Specific to the first configuration of the ring diameter 22, where the diameter 22 and the drumhead diameter are the same, it is clear that the tolerance cannot go positive, otherwise the ring 16 would be too large for the drum for which it is intended.

There are several different approaches to setting the weight of the ring 16. In one approach, the width 24 and thickness 26 are selected to achieve a desired weight. A variation on this approach is for the ring 16 to have the same weight for all or a subset of drumhead diameters and to vary the width 24 and/or thickness 26 of the ring 16 to achieve that desired weight.

In another approach, the width 24 and thickness 26 are the same for all diameters of the ring 16, which means that a ring 16 for a larger diameter drumhead 4 weighs more than a ring 16 for a smaller diameter drumhead 4. For the preferred width 24 of 1 inch and thickness of ⅛ inch, for the ring 16 of FIG. 2, common ring 16 sizes made from raw steel will weigh approximately as shown in Table I below. The ring 16 of FIG. 3 will have half the weight shown in Table I.

TABLE I

| Ring diameter | Approximate weight |
|---|---|
| 10" | 16.0 oz |
| 12" | 19.6 oz |
| 13" | 21.4 oz |

TABLE I-continued

| Ring diameter | Approximate weight |
|---|---|
| 14" | 23.2 oz |
| 16" | 26.8 oz |
| 18" | 30.4 oz |

The present invention allows that the ring weight can be within approximately ±30% of the weight shown in Table I and still provide the desired effects. This range accounts for the range of possible material densities, ring width, and ring thickness. For example, for a 12-inch ring with a preferred weight of 19.6 oz, the minimum weight is 15.1 oz and the maximum weight is 25.5 oz. In order to maintain this range, it is possible that the entire range of one or more of the ring material density, ring width, and ring thickness described above cannot be accommodated. For example, a ring with the minimum weight of 15.1 oz cannot have a combination of the minimum material density of 4.25 oz/in$^3$, the minimum width of ½ inch, and the minimum thickness of 1/16 inch, or else it will fall below that minimum weight.

As indicated above, the dampener 12 has a pad 18 that is attached to at least the bottom surface 32 of the ring 16. The pad 18 is a soft material, such as felt or the loop material of a hook and loop fastener. The pad 18 is attached to the ring 16 preferably by an adhesive that is robust enough to stand up to the strong vibrations caused by the drumhead 4 being struck.

Figure 5:
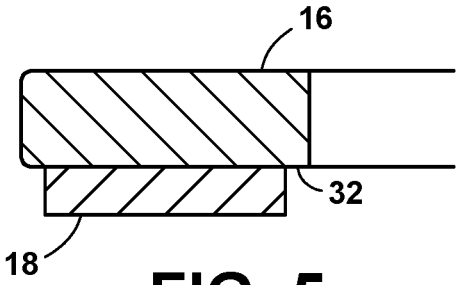
FIG. 5 is a side view of a section of the dampener with a first configuration of the pad.

The present invention contemplates at least two configurations of the pad 18. In the first, the pad 18 is attached only to bottom surface 32 of the ring 16, as in FIG. 5. With this configuration, the diameter 22 of the ring 16 can be the same as the drumhead 4, as discussed above.

Figure 6:
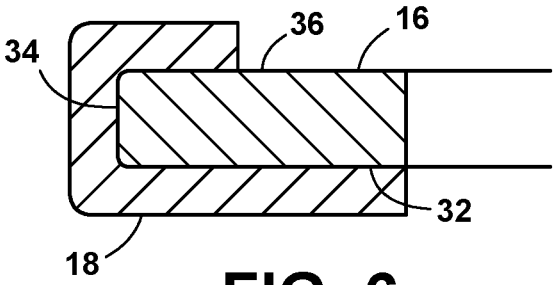
FIG. 6 is a side view of a section of the dampener with a second configuration of the pad.

In a second configuration, shown in FIG. 6, the pad 18 wraps around the ring 16 from the bottom surface 32, around the outer edge 34, to the top surface 36. With this configuration, the diameter 22 of the ring 16 is slightly smaller than that of the drumhead 4, less than twice the thickness of the pad 18. The pad 18 compresses against the hoop 5 when the dampener 12 is installed. In this configuration, the pad 18 prevents rattling and other noises caused by the ring 16 hitting the hoop 5.

Figure 7:
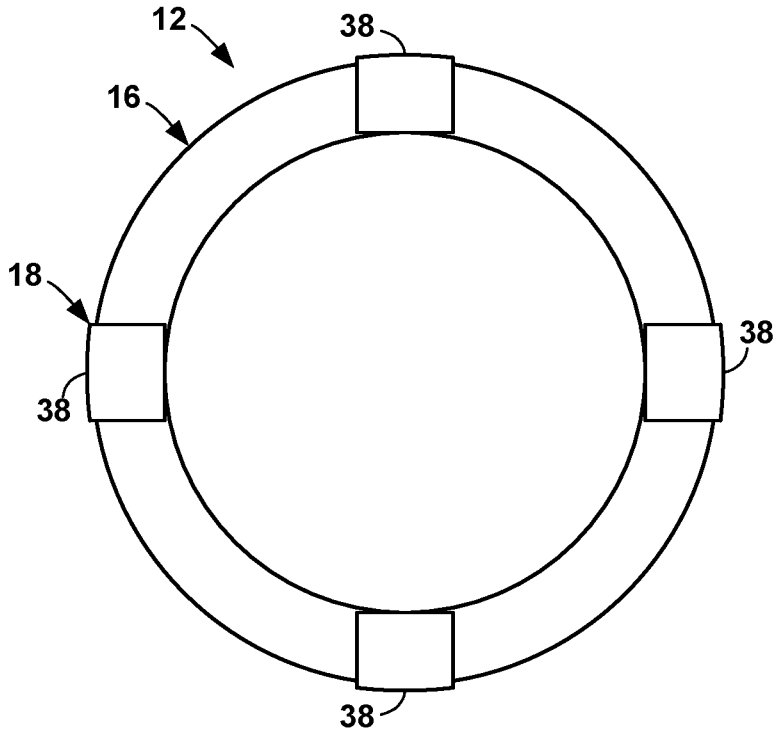
FIG. 7 is a bottom view of a full-annulus dampener with four pad sections.
Figure 8:
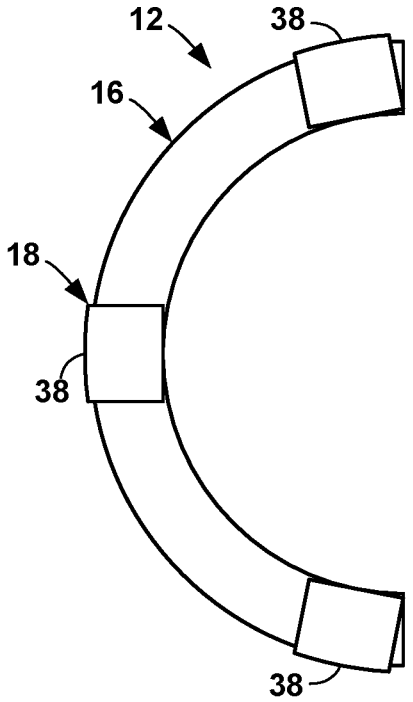
FIG. 8 is a bottom view of a half-annulus dampener with three pad sections.

In one form, the pad 18 is a single piece that extends around the entire circumference of the ring 16. In another form, the pad 18 is a plurality of small pad sections 38 that are spaced around the ring 16, preferably at equal intervals. For example, for a small full-annulus ring 16, there may be four pad sections 38 that are spaced at 90° intervals, as in FIG. 7. In another example, for a large full-annulus ring 16, there may be six pad sections 38 that are spaced at 60° intervals. In another example, for a half-annulus ring 16, there may be three pad sections 38, one at each end and one equidistantly spaced between the ends, as in FIG. 8. For any number of pad sections 38, all of the pad sections 38 together form the pad 18.

The pad sections 38 are in the range of from 1 inch to 3 inches long, with a typical length of about 2 inches. The pad 18 has a thickness in the range of from 1/16 inch to ⅛ inch. The width of the pad 18 depends on the width of the ring 16. For the pad 18 of FIG. 5, the pad width is the same or a bit smaller than the width of the ring 16. For the pad 18 of FIG. 6, because of the way the pad 18 wraps around the ring 16, the pad 18 has a width that is about 1½ times the width of the ring 16.

The pad 18 provides two functions. First, it protects the drumhead 4 and, optionally, the hoop 5 from being abraded or worn by the ring 16. Second, it affects how the dampener 12 influences the tonal quality of the drum 2 by adding a soft buffer between the vibrating drumhead 4 and the ring 16. The pad 18 acts to help absorb vibrations from the drum 2, which in turn contributes to how the dampener 12 enhances the tone and reduces unwanted vibration.

The stabilizer 14 is a clip that holds the dampener 12 in place on the drumhead 4. Shown in FIGS. 9 and 10, the stabilizer 14 has a hook 40 and a foot 42. The hook 40 has a curved body 44 with a curved finger 46 at one end. The body 44 curves around and spans the outside of the hoop 5, and the finger 46 hooks under the bottom of the hoop 5.

An elbow 48 at the other end of the body 44 loops over the top of the hoop 5 and connects the hook 40 to the foot 42. The elbow 48 curves through an angle that is in the range of from 150° to 210°. The foot 42 extends toward the drumhead 4.

Figure 9:
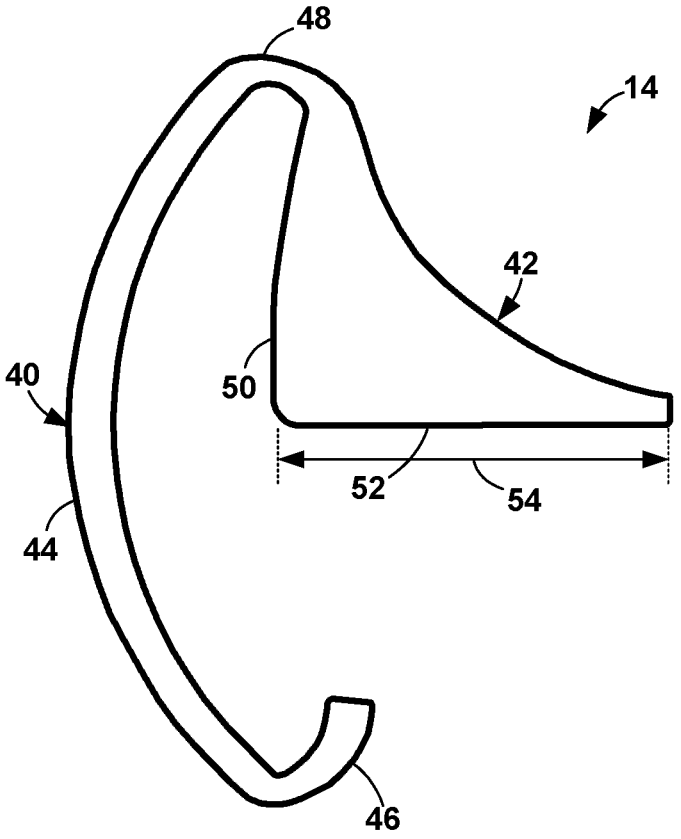
FIG. 9 is a side view of one form of the stabilizer.
Figure 10:
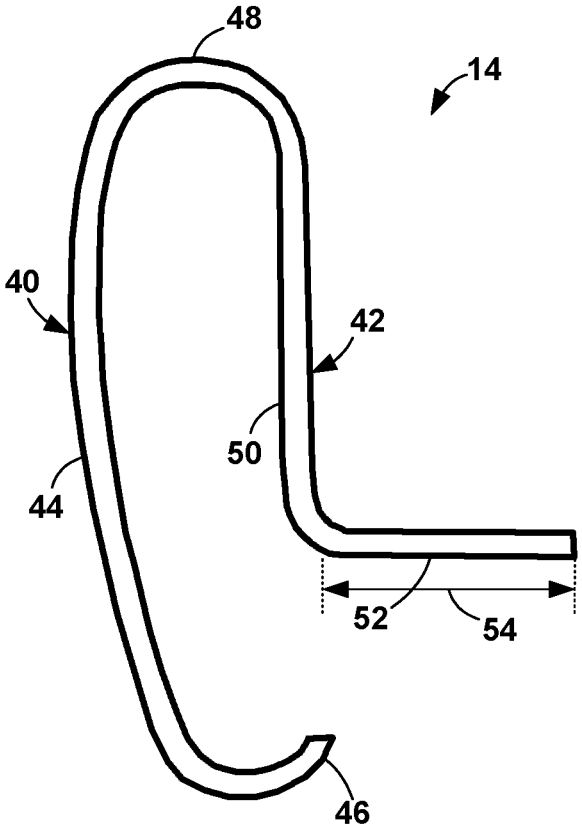
FIG. 10 is a side view of another form of the stabilizer.

The foot 42 of the smaller stabilizer 14 of FIG. 9 is generally wedge-shaped with a bottom 52 that pushes down on the dampener 12 sitting on the drumhead 4. The foot 42 of the larger stabilizer 14 of FIG. 10 is generally L-shaped with a bottom 52 that pushes down on the dampener 12 sitting on the drumhead 4. Typically, the stabilizer 14 will have a height that easily clears the hoop 5 that has a typical height above the drumhead 4.

The heel 48 of the foot 42 may or may not abut the hoop 5 and the foot 42 extends away from the hoop 5 with a length 54 that is enough to hold the dampener 12 against the drumhead 4. The length 54 of the foot 42 depends on the width 24 of the ring 16 and they will typically have about the same dimension. For example, for a 1-inch-wide ring 16, the foot length 54 will be about 1 inch.

Figure 11:
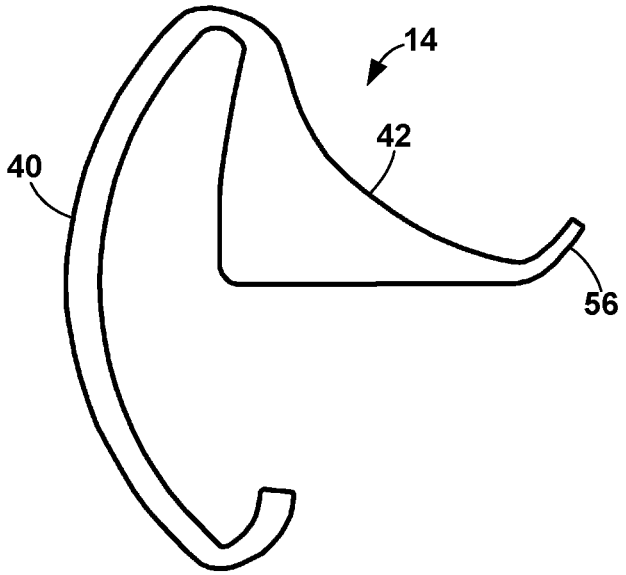
FIG. 11 is a side view of the stabilizer with a toe.

Optionally, as shown in FIG. 11, the stabilizer 14 has a toe 56 at the end of the foot 42 that bends upwardly from the drumhead 4. The toe 56 facilitates easy removal of the stabilizer 12 by providing a notch for the user's finger to enable lifting the foot 42 from the dampener 12.

The stabilizer has a width in the range of from 1 inch to 2 inches, with a preferred width of 1½ inches. The body 44 has a height that allows it to hook under the hoop 5 and span the hoop 5 upwardly. A smaller size, like that in FIG. 9, can typically be used for all smaller drums and has a height of about 1½ inches. A larger size, like that in FIG. 10, is typically used for a kick drum and has a height of about 2 inches.

The stabilizer 14 is composed of a material that holds its undeformed shape but that can flex enough that the stabilizer 14 can be installed on the drum 2 as described below. The stabilizer 14 returns to its undeformed shape when removed from the drum 2. Contemplated materials include a somewhat flexible plastic or rubber. The material also allows that stabilizer 14 to flex slightly away from the drumhead 4 when the drumhead 4 is struck.

Optionally, the dampener 12 and stabilizer 14 include a mechanism 60 for retaining the dampener 12 in the correct position on the drumhead 4. In the present design, the mechanism 60 comprises a plurality of studs 62 extending from the top surface 36 of the ring 16 and a complementary hole 64 in the foot 42 of each stabilizer 14.

Figure 3:
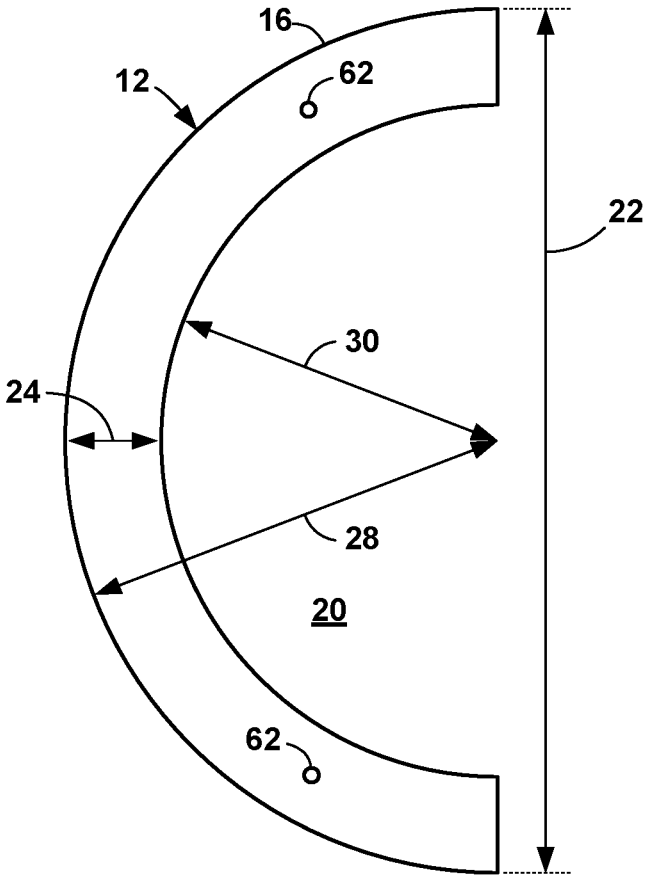
FIG. 3 is a top view of another configuration of the dampener.
Figure 12:
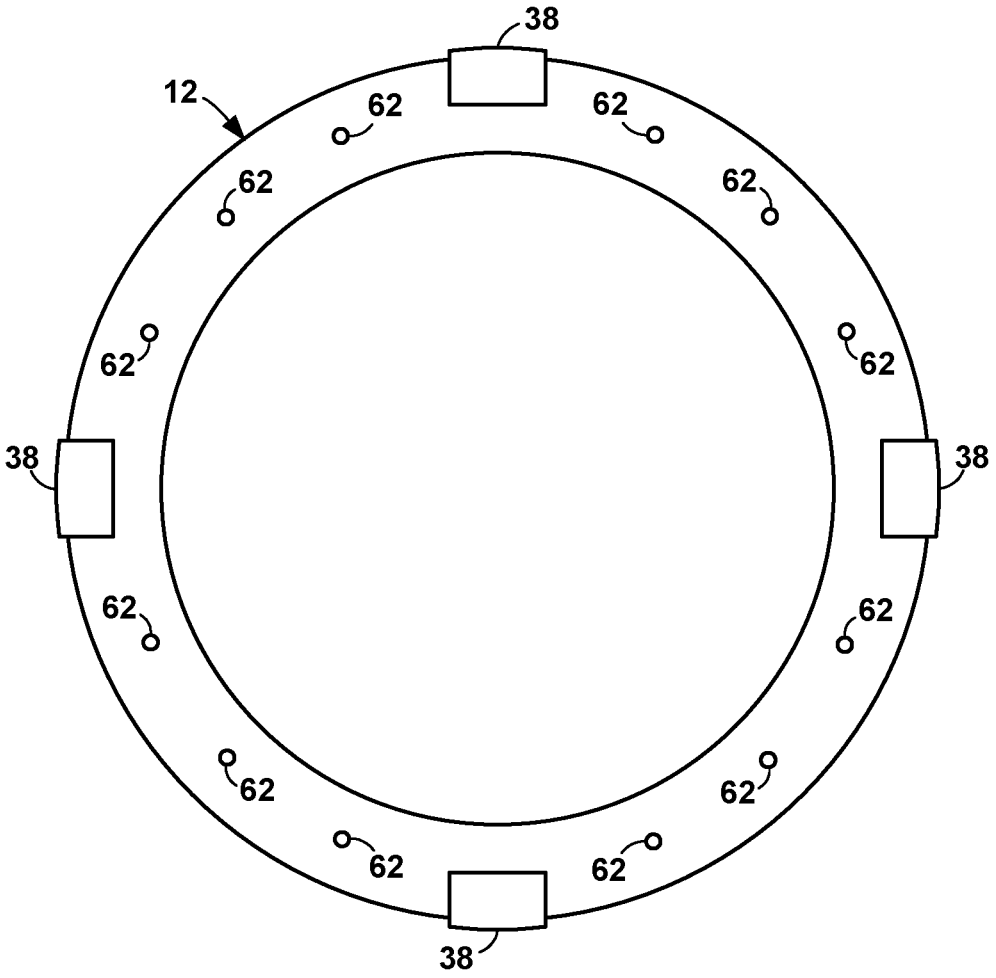
FIG. 12 is a top view of the ring showing regularly spaced studs.

There is at least one stud 62 for each stabilizer 14 that will be used, as described below. Typically, though not necessarily, the studs 62 are regularly spaced around the ring 16. For example, the studs 62 can be equally spaced around the ring 16. In another example, the studs can be spaced in a regular pattern around the ring 16, such as equally spaced set of studs 62 between each pair of adjacent pad sections 38. FIG. 2 shows a full-annulus dampener 12 with six studs 62 spaced at 60° intervals. FIG. 3 shows a half-annulus dampener 12 with two studs 60 spaced 120° apart. FIG. 12 shows four sets of three studs 62, each set equally spaced and positioned between adjacent pairs of pad sections 38.

Figure 13:
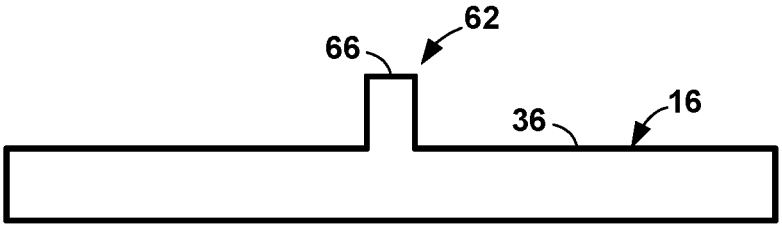
FIG. 13 is a cross-sectional view of one example form of stud.
Figure 14:
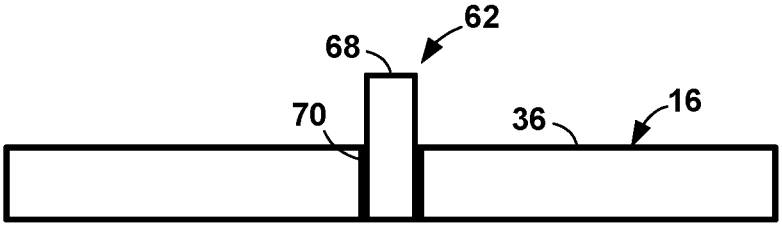
FIG. 14 is a cross-sectional view of another example form of stud.

The studs 62 can be formed in any appropriate manner. In one example, shown in FIG. 13, the studs 62 are formed as an integral element 66 of the ring 16 when it is made, such as by casting. In another example, shown in FIG. 14, the stud 62 is a rod 68 that is bonded in a hole 70, such as by press-fit or adhesive, so that it extends from the hole 70.

Figure 15:
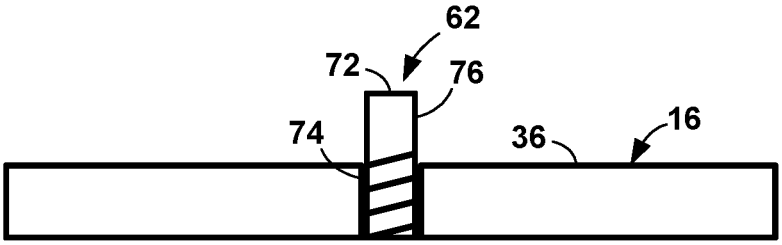
FIG. 15 is a cross-sectional view of another example form of stud.
Figure 16:
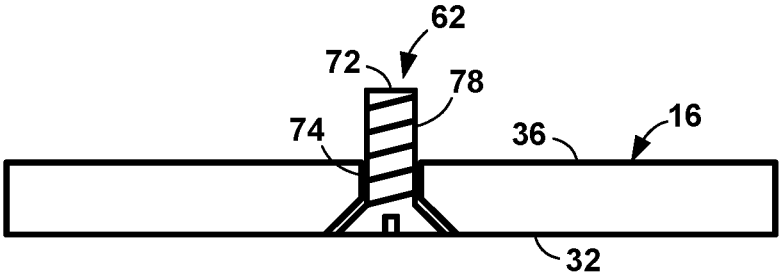
FIG. 16 is a cross-sectional view of another example form of stud.

In another example, the stud 62 is a threaded shaft 72 that is turned into a threaded hole 74 in the ring 16 so that it extends from the hole 74. In one form, shown in FIG. 15, the threaded shaft 72 is a rod 76 that is threaded at one end and turned into the hole 74 from the top surface 36. In another form, shown in FIG. 16, the threaded shaft 72 is a screw 78 that is turned into the hole 74 from the bottom surface 32 until the screw 78 extends from the hole 74. The screw 78 is countersunk so that it does not interfere with the pad 18 or touch the drumhead 4.

With the threaded form of stud 62, the ring 16 can be made with a large number of threaded holes 74 that gives the user flexibility in determining the locations of the studs 62.

Having more threaded holes 74 than are needed for the studs 62 plus the significant stability of the dampener 12 affords the opportunity to add accessories to the dampener 12. For example, small percussive devices can be screwed into the threaded holes 74. Alternatively, one or more rods can be screwed into the threaded holes 74 and accessories mounted above the dampener 12 on the rod.

These are merely examples of ways to form the studs 62 and are not intended to be an exhaustive list.

Figure 17:
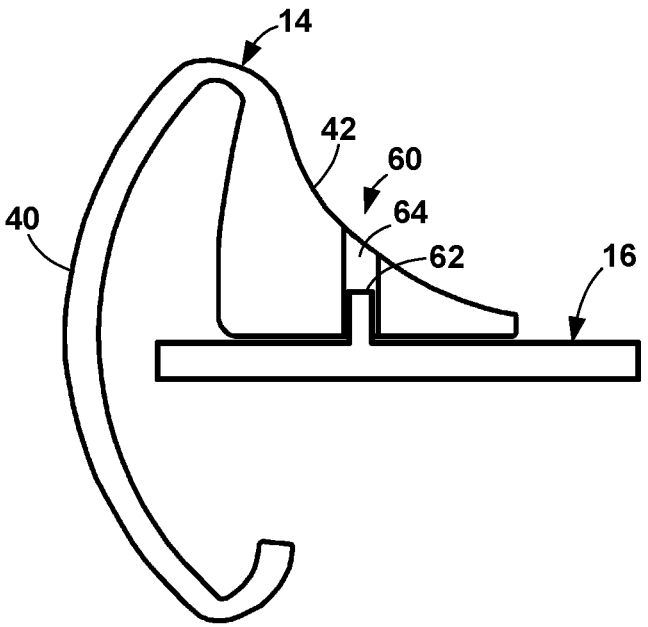
FIG. 17 is a cross-sectional, side view of the one configuration of the retaining mechanism.

As can be seen in FIG. 17, when the stabilizer 14 is installed on the dampener 12, the hole 64 in the stabilizer foot 42 fits over the stud 62. Consequently, the stud 62 and hole 64 must be placed in complementary locations on the ring 16 and foot 42, respectively.

Figure 18:
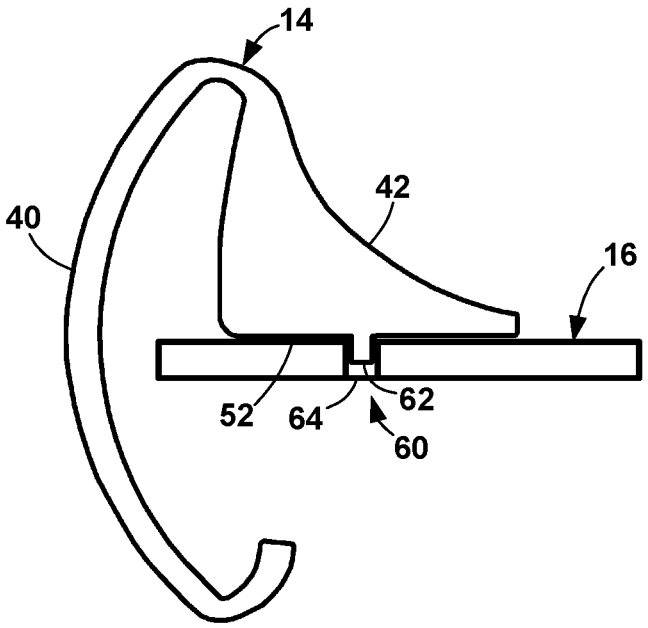
FIG. 18 is a cross-sectional, side view of an alternative configuration of the retaining mechanism.

Alternatively, as shown in FIG. 18, the stud 62 and hole 64 are reversed such that the stud 62 extends from the bottom surface 52 of the foot 42 and fits into a hole 64 in the ring 16. The stabilizer 18 can be molded with the stud 62 as an integral component.

Figure 19:
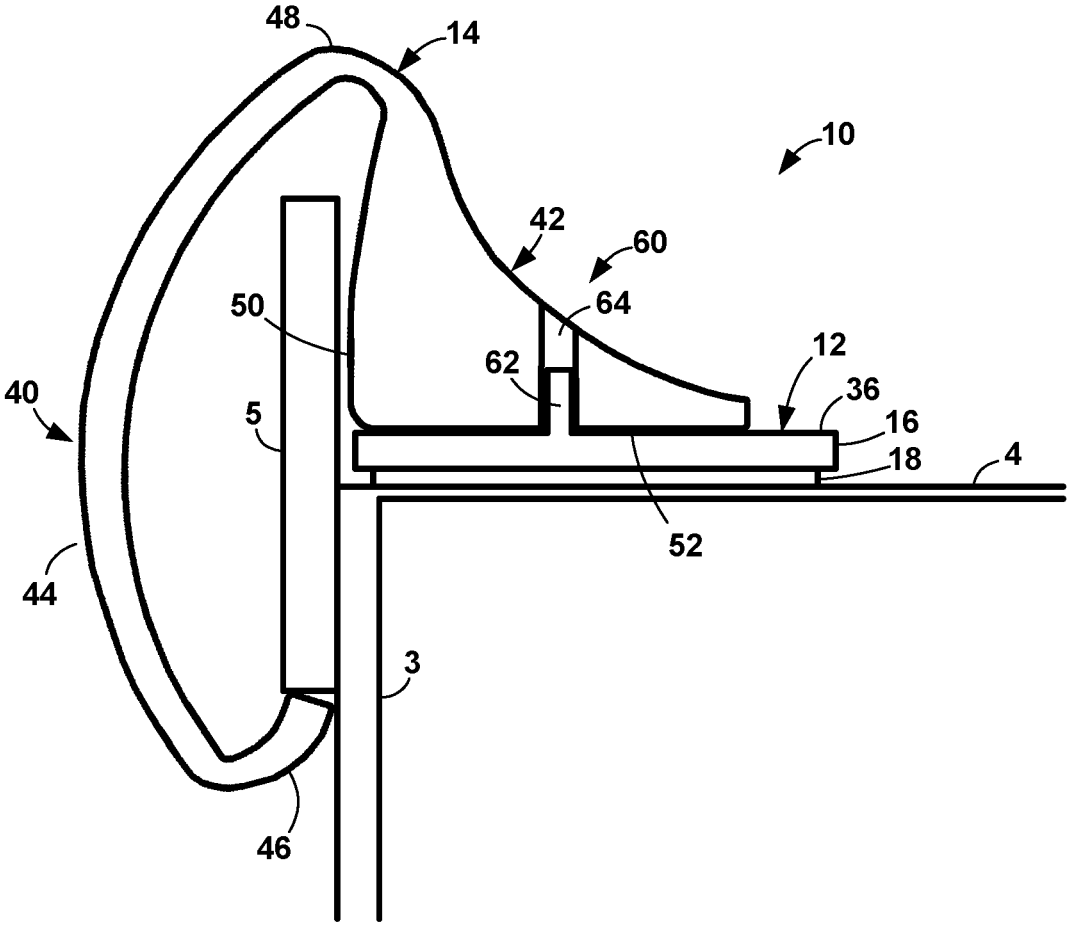
FIG. 19 is a detailed, cross-sectional view of a dampener and a stabilizer installed on a smaller drum.
Figure 20:
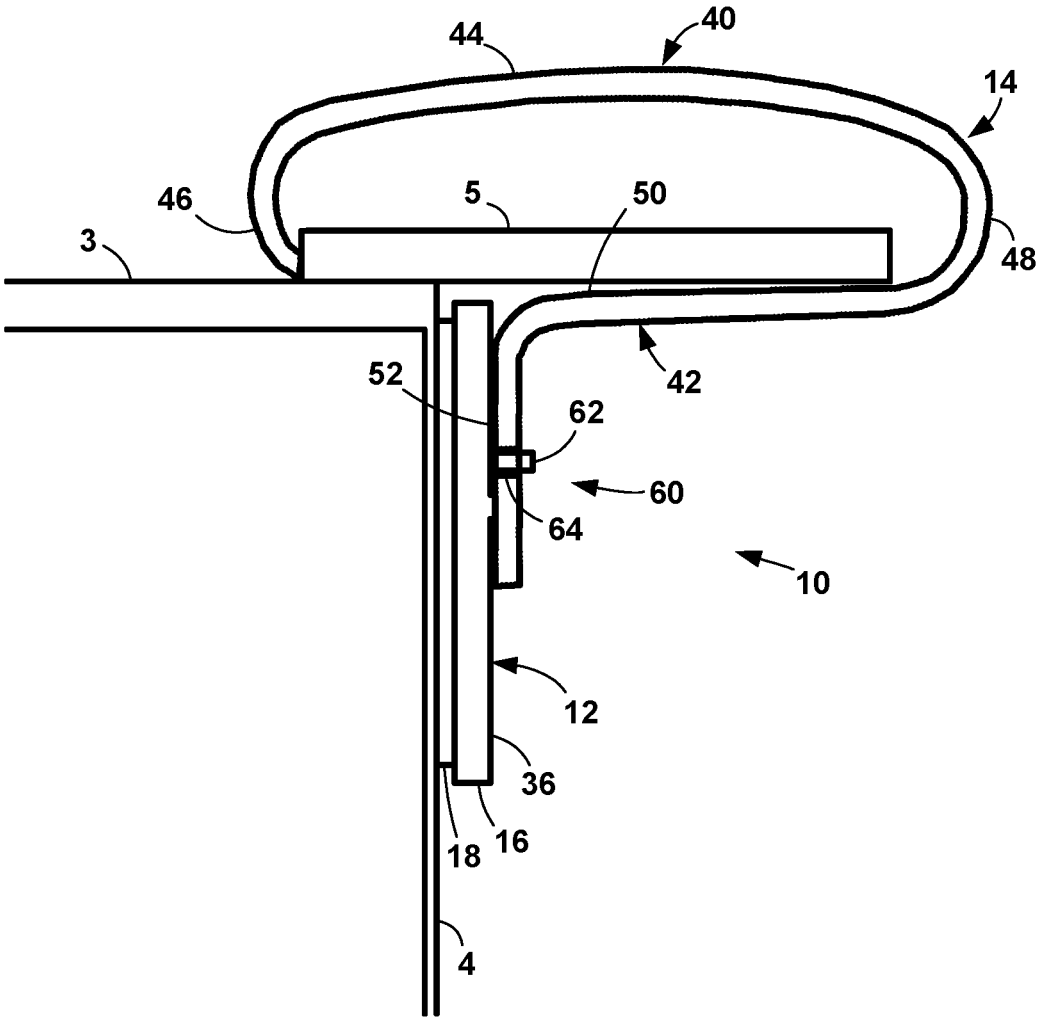
FIG. 20 is a detailed, cross-sectional view of the dampener and a stabilizer installed on a kick drum.

The drum dampener kit 10 is installed by first laying the dampener 12 against the drumhead 4. For each of the stabilizers 14, the stabilizer finger 46 is hooked under the hoop 5, and the foot 42 is raised to bend the elbow 48. The elbow 52 is hooked over the top of the hoop 5 and the foot 42 is allowed to drop until the bottom 52 of the foot 42 abuts the dampener 12, making sure that the stud 62 and hole 64 are aligned. Alternatively, the elbow of each stabilizer 14 is placed over the top of the hoop 5 such that the bottom 52 of each stabilizer foot 42 abuts the dampener 12, making sure that the stud 62 and hole 64 are aligned. Then the finger 46 is hooked under the hoop 5. FIGS. 19 and 20 are detailed views of how the dampener 12 and stabilizer 14 fit a smaller, horizontal drum and a kick drum, respectively.

Figure 21:
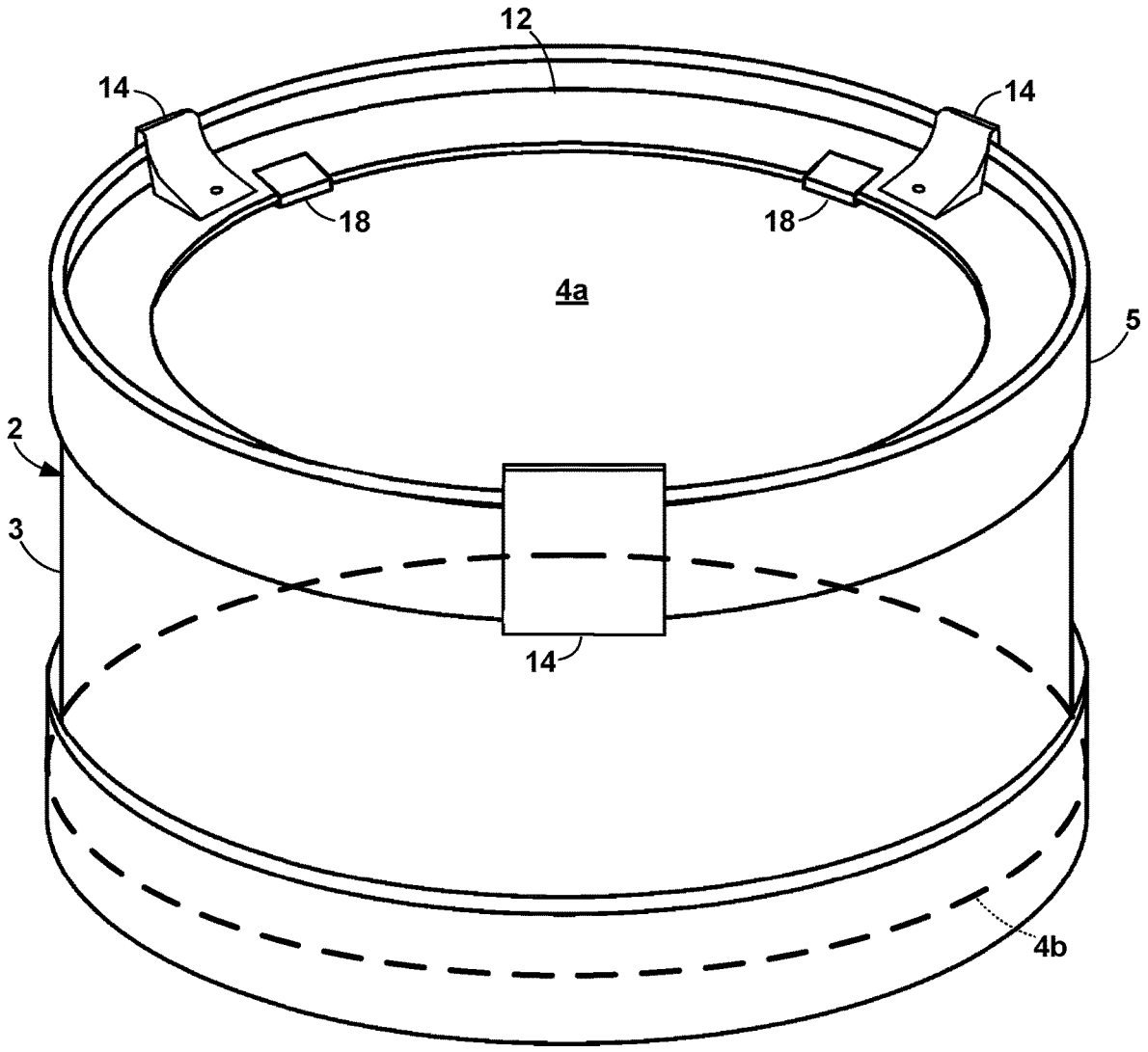
FIG. 21 is a perspective view of the drum dampener kit with a full-annulus dampener installed on a horizontal drum.
Figure 22:
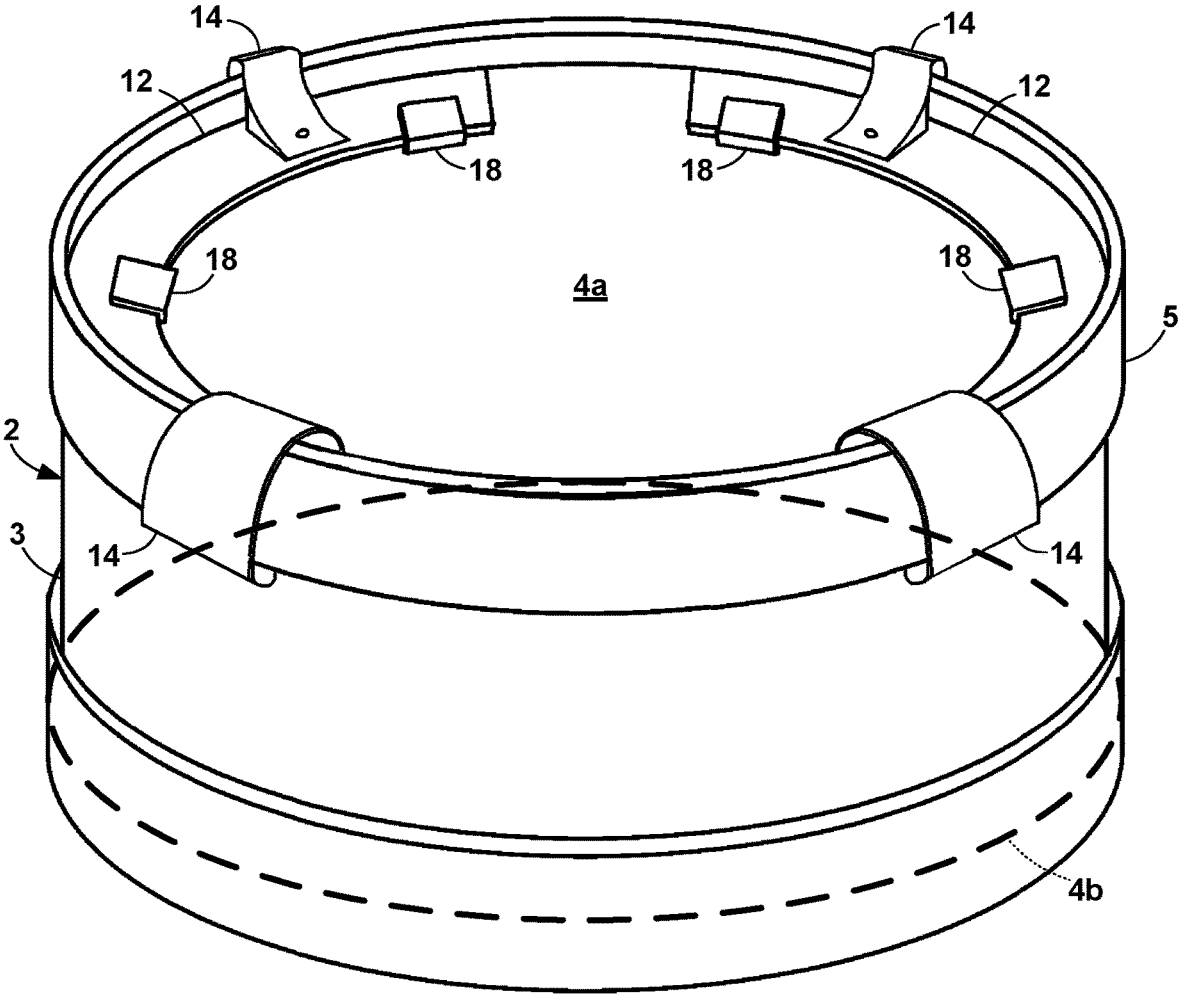
FIG. 22 is a perspective view of the drum dampener kit with a two, half-annulus dampeners installed on a horizontal drum.
Figure 23:
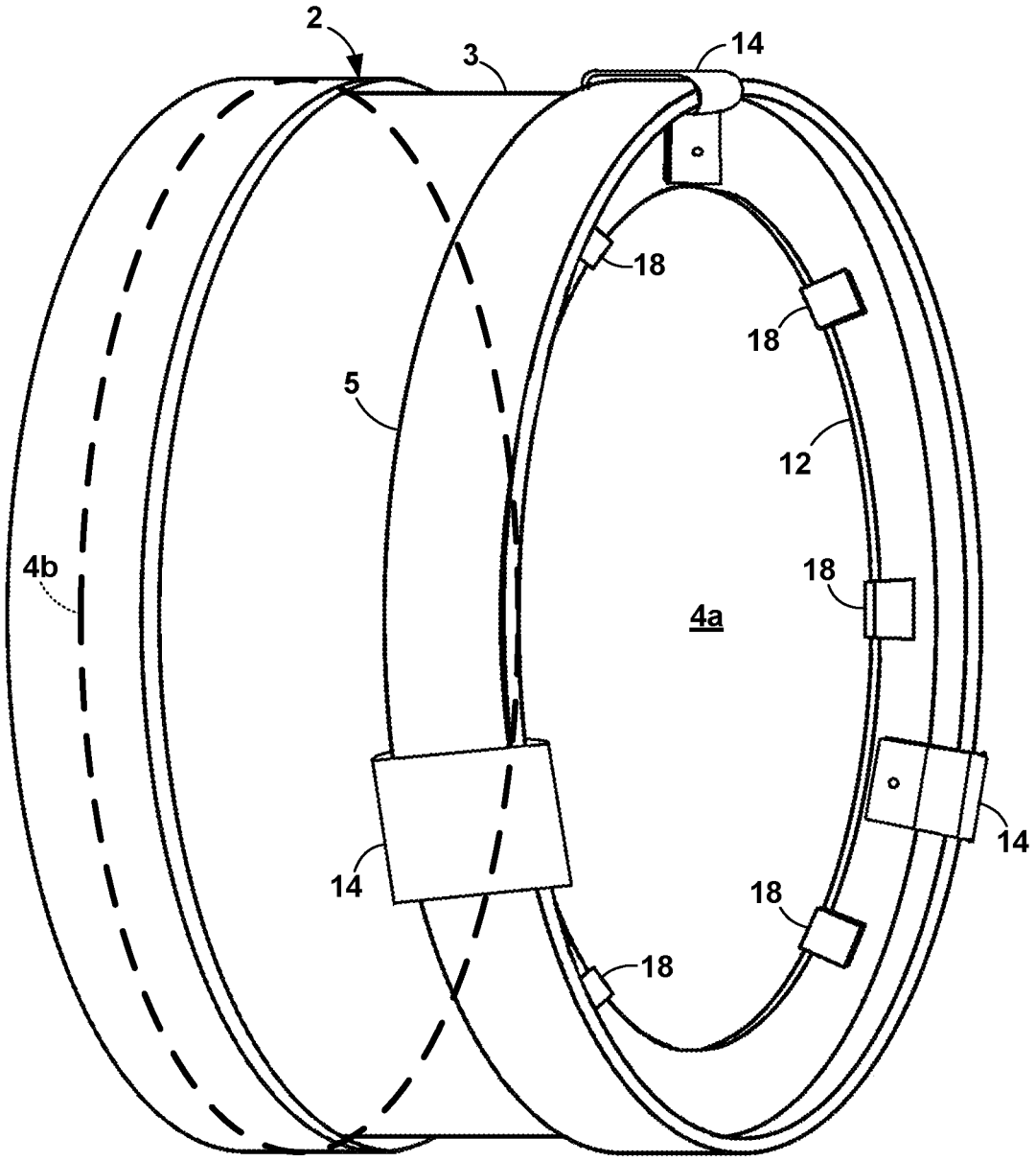
FIG. 23 is a perspective view of the drum dampener kit with a full-annulus dampener installed on a kick drum.

FIGS. 21-23 show the drum dampener kit 10 installed on the batter head 4*a* of a drum 2. As mentioned above, the drum dampener kit 10 can also be installed on the resonant head 4*b*. The number of stabilizers 24 needed depends on the configuration of the dampener(s) 12. For example, if a single full ring dampener 12 is used, three stabilizers 14 are typically sufficient to hold the dampener 12 in place, as in FIGS. 21 and 23. For example, if two half-ring dampeners 12 are used, each dampener 12 typically needs two stabilizers 14, as in FIG. 22.

Thus, it has been shown and described a drum dampener. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A drum dampener kit for a drum having a drumhead with a diameter and a hoop, the drum dampener kit comprising:

(a) a dampener including a ring and a pad, the ring being an annulus with a top surface, a bottom surface, an outer edge, a width in the range of from ½ inch to 1½ inch, a thickness in the range of from 1/16 inch to 3/16 inch, a diameter adapted for the drumhead diameter, and composed of a material with a density in the range of from 4.25 oz/in$^3$ to 4.75 oz/in$^3$, the pad being composed of a soft material and attached to at least the bottom surface of the ring;

(b) a plurality of stabilizers, each stabilizer comprising a hook and a foot, the hook having a body adapted to span the outside of the drum hoop, a finger at one end of the body adapted to hook under the drum hoop, and an elbow at the other end of the body adapted to loop over the top of the hoop through an angle in the range of from 150° to 210°, the foot extending from the elbow having a bottom surface that abuts the top surface of the ring, the stabilizer being composed of a material that deforms to install on the drum and return to its undeformed state when removed from the drum.

2. The drum dampener kit of claim 1 wherein the ring is composed of steel.

3. The drum dampener kit of claim 1 wherein the ring is powder coated.

4. The drum dampener kit of claim 1 wherein the ring width is about 1 inch, and the ring thickness is about ⅛ inch.

5. The drum dampener kit of claim 1 wherein the pad is attached to the bottom surface, wrapped around the outer edge, and attached to the top surface.

6. The drum dampener kit of claim 1 wherein the pad is comprised of a plurality of pad sections spaced around the ring.

7. The drum dampener kit of claim 6 wherein the pad sections are spaced at equal intervals.

8. The drum dampener kit of claim 1 further comprising a retaining mechanism including a plurality of studs extending from the top surface of the ring and a complementary hole in each stabilizer foot.

9. The drum dampener kit of claim 8 wherein each stud is comprised of a threaded hole in the ring and a threaded shaft turned into the threaded hole.

10. The drum dampener kit of claim 9 wherein the threaded holes are regularly spaced around the ring.

11. The drum dampener kit of claim 8 wherein the studs are regularly spaced around the ring.

12. The drum dampener kit of claim 1 further comprising a retaining mechanism including at least one stud extending from each stabilizer foot bottom and a plurality of complementary holes in the ring.

13. The drum dampener kit of claim 12 wherein the holes are regularly spaced around the ring.

14. A drum dampener kit for a drum having a drumhead with a diameter and a hoop, the drum dampener kit comprising:

(a) a dampener including a steel ring and a pad, the ring being an annulus with a top surface, a bottom surface, an outer edge, a width in the range of from ½ inch to 1½ inch, a thickness in the range of from 1/16 inch to 3/16 inch, and a diameter adapted for the drumhead diameter, the pad being a plurality of pad sections spaced around the ring, composed of a soft material, and attached to the bottom surface, wrapped around the outer edge, and attached to the top surface;

(b) a plurality of stabilizers, each stabilizer comprising a hook and a foot, the hook having a body adapted to span the outside of the drum hoop, a finger at one end of the body adapted to hook under the drum hoop, and an elbow at the other end of the body adapted to loop over the top of the hoop through an angle in the range of from 150° to 210°, the foot extending from the elbow having a bottom surface that abuts the top surface of the ring, the stabilizer being composed of a material that deforms to install on the drum and return to its undeformed state when removed from the drum; and (c) a retaining mechanism including a plurality of studs extending from the top surface of the ring and a complementary hole in each stabilizer foot.

15. The drum dampener kit of claim 14 wherein the ring is powder coated.

16. The drum dampener kit of claim 14 wherein the ring width is about 1 inch, and the ring thickness is about ⅛ inch.

17. The drum dampener kit of claim 14 wherein the pad sections are spaced at equal intervals.

18. The drum dampener kit of claim 14 wherein the studs are regularly spaced around the ring.

19. The drum dampener kit of claim 14 wherein each stud is comprised of a threaded hole in the ring and a threaded shaft turned into the threaded hole.

20. The drum dampener kit of claim 19 wherein the threaded holes are regularly spaced around the ring.

* * * * *